US005900576A

United States Patent [19]

Gabriel

[11] Patent Number: 5,900,576

[45] Date of Patent: May 4, 1999

[54] SEMI-RIGID LOCKING SYSTEM FOR A FIREARM

[76] Inventor: Franz Gabriel, Schimmelgasse 8, 2551 Enzesfeld, Austria

[21] Appl. No.: 08/697,417

[22] Filed: Oct. 30, 1996

[51] Int. Cl.[6] ..... F41A 3/46

[52] U.S. Cl. ..... 89/187.01; 89/187.02

[58] Field of Search ..... 89/187.01, 187.02, 89/180, 181, 189, 188

[56] References Cited

U.S. PATENT DOCUMENTS

| | | | |
|---|---|---|---|
| 2,089,671 | 8/1937 | Stecke | 89/187.01 |
| 2,626,474 | 1/1953 | Lochhead | 89/187.01 |
| 2,890,626 | 6/1959 | Amsler | 89/180 |
| 2,900,877 | 8/1959 | McClenahan | 89/187.01 |
| 2,921,502 | 1/1960 | Amsler | 89/187.02 |
| 3,199,407 | 8/1965 | Henisa | 89/187.01 |

FOREIGN PATENT DOCUMENTS

| | | | |
|---|---|---|---|
| 507861 | 6/1939 | United Kingdom | 89/187.02 |
| 799087 | 7/1958 | United Kingdom | 89/187.02 |
| 8500216 | 1/1985 | WIPO | 89/187.02 |

*Primary Examiner*—Stephen M. Johnson
*Attorney, Agent, or Firm*—Henry M. Feiereisen

[57] ABSTRACT

A semi-rigid locking system for a firearm is described. The locking mechanism has a breech block which is locked with the stock and which can be released by a spring-biased control member. The breech block has at least one bore which receives a locking element supported for radial movement in the bore. When the breech block is in the locked position, the locking element is supported by the control member and engages the stationary locking surface. When the breech block is in the release position, the locking element is released by the control member which moves in the breech block parallel to the breech block. The locking element does then also no longer engage the locking surface and can move freely. The control member has control surfaces which are inclined at different angles with respect to its axis, while the locking element has control surfaces which are complementary to the control surfaces of the control member. When the breech block is in the locked position, a clearance is provided between the locking surface and the locking element on the side facing away from the barrel.

6 Claims, 15 Drawing Sheets

SEMI-RIGID LOCKING SYSTEM FOR A FIREARM

BACKGROUND OF THE INVENTION

The present invention refers to a semirigid locking system for a firearm of a type having a breech block which travels between a locked position in which the breech is fixed to the stock and a release position in which the breech is disengaged from the stock through actuation of a spring-loaded control member which is received within the breech.

Austrian Pat. No. 382 760 discloses a locking system of this type in which the breech has at least one bore for supporting a radially movable locking element which is in registration with an engagement surface of the stock in locked position of the breech while being supported by the control member, and is disengaged from the engagement surface in release position of the breech block through displacement of the control member in parallel relationship to the breech.

A drawback of this conventional locking system is its rigid configuration, with locking elements being formed as toroidal segment and in registry in locked position of the breech block with the engagement surface in form of an annular groove. The disengagement of the breech block is effected by a separate gas control system. In a locking system of this type, the locking elements are subject to a shearing action between the stock and the breech block which is commensurate with the total energy of the cartridge. The annular groove adversely effects the stability and the oscillation behavior of the stock. Moreover, as a result of the unattenuated cartridge power, this type of locking system does not permit the use of light metals or plastic material as increasingly demanded to date.

SUMMARY OF THE INVENTION

It is an object of the present invention to provide an improved locking system for a firearm, obviating the aforestated drawbacks.

In particular, it is an object of the present invention to provide an improved locking system for a firearm, exhibiting a reduced recoil so that the dynamics of the breech are perceived by the shooter in an elastic or attenuated manner.

These objects and others which will become apparent hereinafter are attained in accordance with the present invention by providing a breech which accommodates a control member formed with control surfaces which exhibit different angles relative to the axis of the control member and interact with complementary control surfaces of the locking element wherein the locking element in registration with the engagement surface of the stock with clearance in locked position of the breech on the barrel-distant side of the breech.

Compared to conventional locking systems which transmit the entire recoil energy to the shooter via the stock and butt, the locking system according to the present invention transmits the recoil energy not suddenly in full force but spreads it in a time-controlled manner over several phases to the shooter so as to convey a sliding motion.

Advantageously, at cylindrical configuration of the breech block, the locking element exhibits in axial direction of the breech a substantially sector-like configuration with clipped tip. Furthermore, the locking element may be designed at cylindrical configuration of the breech block in such a manner that its radially outer side is bounded by a toroidal surface and that the engagement surface of the stock is also bounded by a toroidal surface having a radius that is greater than the radius of the toroidal surface of the locking element by half the clearance. Alternatively, at cylindrical breech block, the locking element may be bounded on its radially outer side and on its barrel-distant sided by at least one conical surface.

According to another feature of the present invention, the breech block as well as the locking element may also be designed of prismatic configuration, in which case, it is advantageous to bound the locking element on its radially outer side by a cylindrical surface and to bound the engagement surface also by cylindrical surface of a radius which exceeds the radius of the cylindrical surface of the locking element by half the clearance.

BRIEF DESCRIPTION OF THE DRAWING

The above and other objects, features and advantages of the present invention will now be described in more detail with reference to the accompanying drawing in which:

FIG. 10.1 is an isometric view of a third type of a locking element;

DETAILED DESCRIPTION OF PREFERRED EMBODIMENTS

Figure 1:
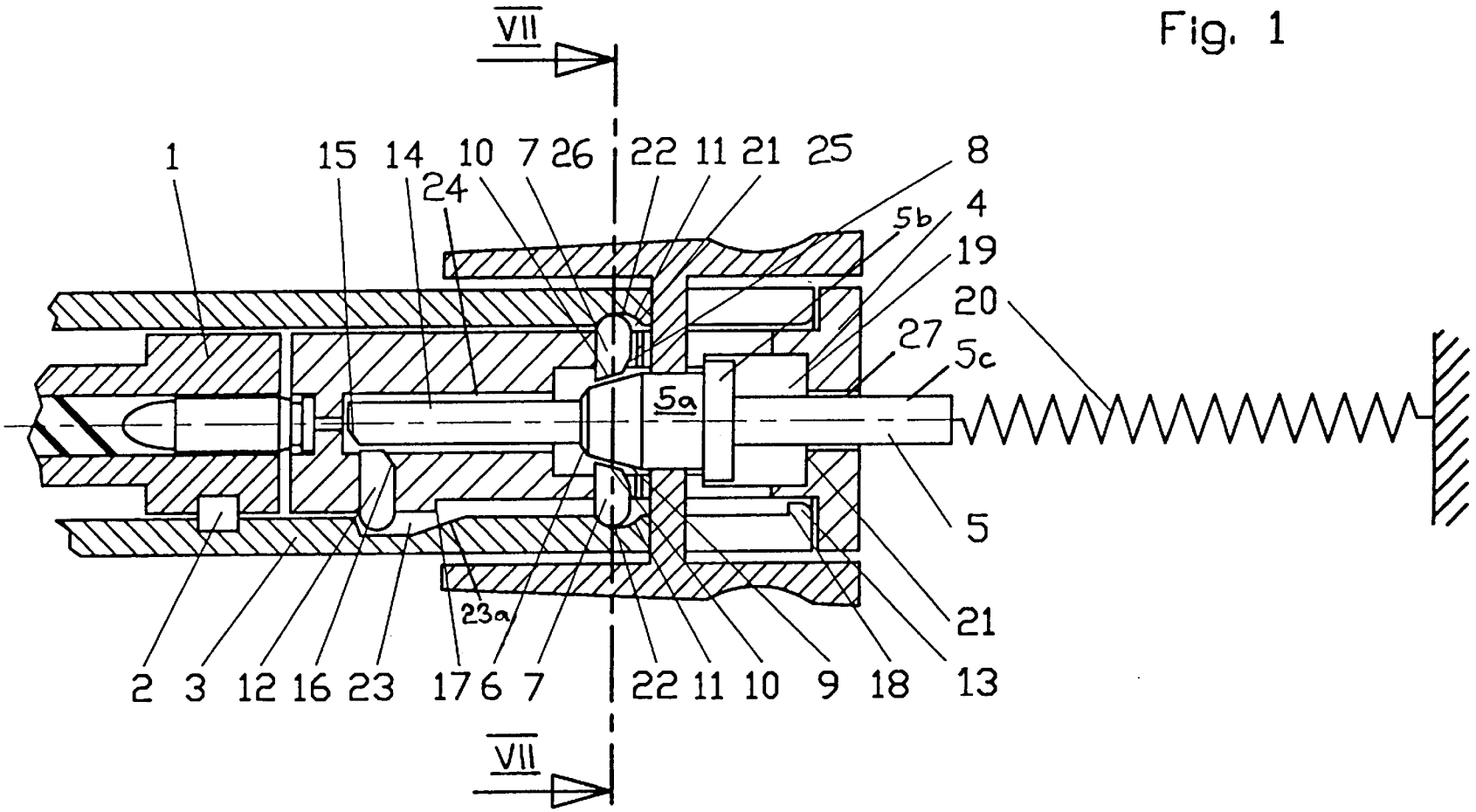
FIG. 1 is a fragmented, schematic longitudinal section of a firearm according to the present invention, illustrating one embodiment of a locking system in locked disposition of the breech block.

Throughout all the Figures, the same or corresponding elements are always indicated by the same reference numerals.

Turning now to the drawing, and in particular to FIG. 1, there is shown a fragmented, schematic longitudinal section of a firearm equipped with a locking system according to the present invention, illustrating in detail the area of the breech block mechanism. The firearm has a stock 3 and a barrel 1 which is fixedly secured to the stock 3 by a barrel lock 2. Supported in the stock 3 for displacement in a longitudinal direction is a breech block 4 which is formed with an axial bore 24 of step-shaped configuration to support and guide for displacement in longitudinal direction a control member, generally designated by reference numeral 5 and accommodating therein the firing pin (not shown). The control member 5 has a head 5*a* which is securely fitted in a passage of a cocking slide 26 and has a stop plate 5*b* disposed in a cavity 19 formed in a rearward section of the breech 4 and exhibiting a barrel-distant boundary surface 21 so as to limiting the axial displacement of the control member 5 during firing of the gun.

The head 5*a* has a barrel-facing forward section formed with a control surface 6 which is followed rearwardly by a control surface 9. The control surfaces 6, 9 extend at different angles with regard to the barrel axis L, indicated in dashdot line. Extending the head 5*a* of the control member 5 forwardly in axial direction is a prolongation 14 which is received in the forward part of the bore 24. The head 5*a* is further provided with a rod 5*c* which extends out from the stop plate 5*b* in axial direction through a bore 27 of the breech block 4 and is acted upon by a closing spring 20 which extends between the rod 5*c* and a suitable point of attachment of the stock 3 and by which the control member 5 and the breech block 4 are held in locked disposition with the stock 3.

The breech 4 is formed with spaced passages 25 about the periphery of the breech block 4 for receiving a respective number of locking elements 7. The locking elements 7 are movably received in the passages 25 for displacement in a radial direction for cooperation with the control member 5. Although not shown in detail in the drawings, the locking elements 7 are secured within the passages 25 against loss by a suitable fastening pin.

Figure 7:
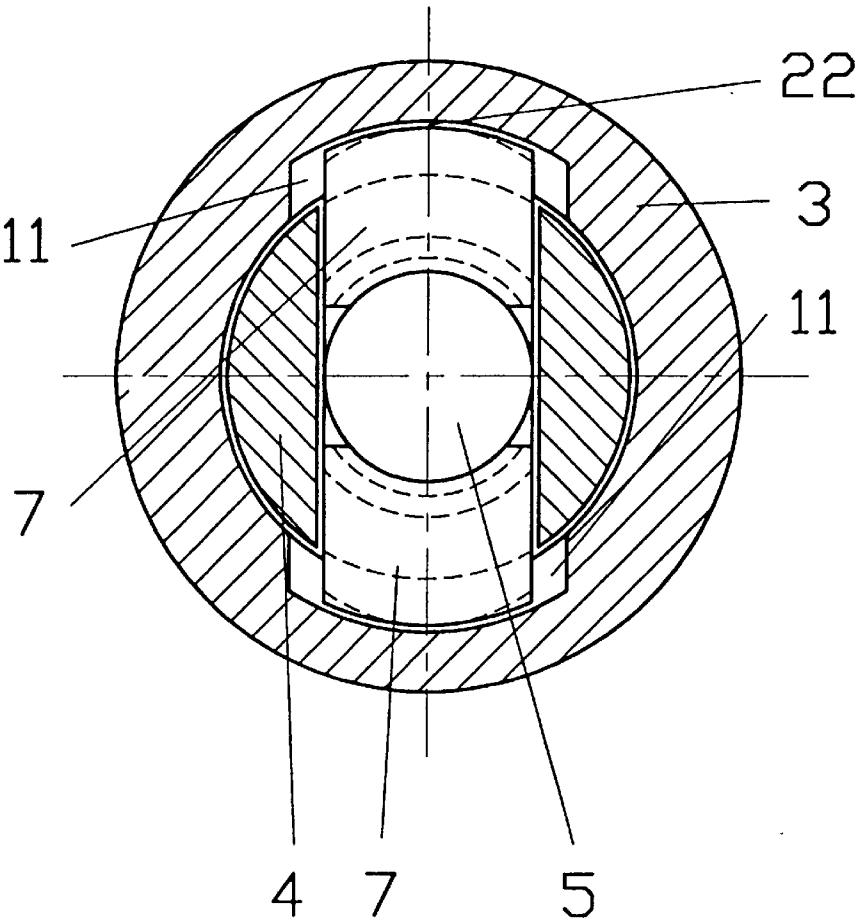
FIG. 7 is a cross sectional view of the firearm taken along the line VII—VII in FIG. 1.

At their end facing the control member 5, each locking element 7 exhibits control surfaces 8, 10 which extend at same angles relative to the axis L as the control surfaces 6, 9 of the control member 5. At their ends 22 distant to the control member 5, the locking elements 7 are engageable in engagement surfaces 11 formed about the inside perimeter of the stock 3 and held in this disposition through support upon the control member 5. The ends 22 of the locking elements 7 have smaller dimensions than the engagement surfaces 11 in the stock 3 so that the locking elements 7 are held in the engagement surfaces 11 with clearance, as shown in particular in FIG. 7. The dimension of the clearance is suitably dependent on the caliber and the length of the barrel 1. For example, for a pistol of caliber .40 S&W and a barrel length of 125 mm, the clearance ranges between 0.25 and 0.40 mm.

Upon cylindrical configuration of the breech block 4, the engagement surfaces 11 of the stock 3 and the cooperating ends 22 of the locking elements 7 are each bounded by a part of a toroidal surface. Upon prismatic (polygonal) configuration of the breech block 4, the engagement surfaces 11 of the stock 3 and the cooperating ends 22 of the locking elements 7 are each bounded by a cylindrical or prism-shaped surface.

As is conventional in straight line breeches block, the control member 5 is formed as cocking slide.

In the area of its barrel-proximate end, the breech block 4 is formed with a radial passage for supporting and guiding an support pin 12 for movement in radial direction for cooperation with the prolongation 14 of the control member 5. The support pin 12 is formed on its barrel-distant side face with a slanted control surface 16 which interacts with a complimentary control surface 15 at the barrel-facing end of the prolongation 14 of the control member 5. The prolongation-distant end of the support pin 12 is received in a pocket 23 of the stock 3, with the pocket 23 exhibiting a slanted ramp 23*a* at the barrel-distant end.

In a proximate area of the support pin 12, the breech block 4 is formed with a shoulder 17 for cooperation with a stop face 18 of a hook-shaped stop member 13 which is positioned at the barrel-distant end of the stock 3.

Figure 2:
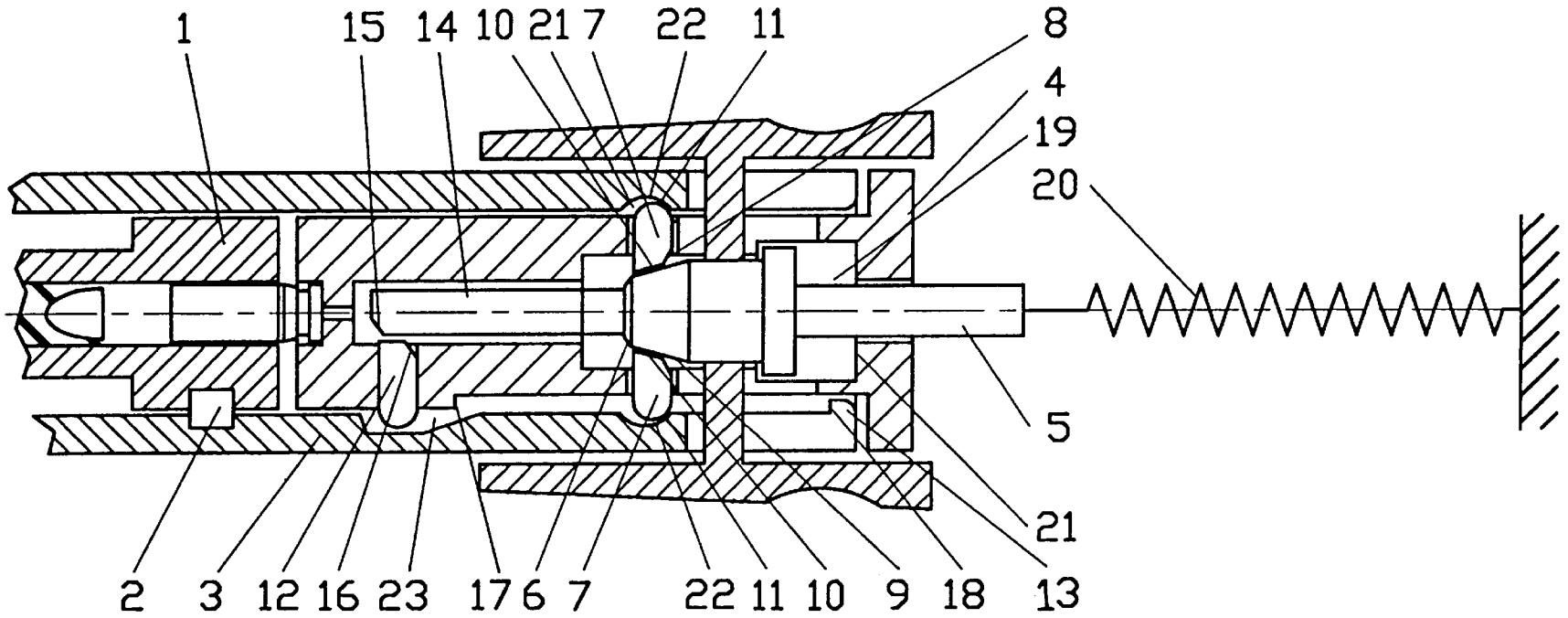
FIG. 2 is a fragmented, schematic longitudinal section of the firearm, illustrating the locking system at the moment of firing the cartridge.

FIG. 2 shows the locking system at the moment of firing of the cartridge to propel a bullet through the barrel 1, at which point the breech block 4 together with the control member 5 receives an impulse which is directed in opposition to the force exerted by the closing spring 20. As a consequence of the clearance between the locking elements 7 and the engagement surfaces 11, the breech 4 and the control member 5 assume the function of a kick absorber which in a first phase of the opening action absorbs a portion of the recoil energy and thus initially moves backwards in correspondence to the clearance. A further displacement of the breech block 4 is at first prevented by the locking elements 7. Although the breech 4 is stopped by the sudden impact of impact area 28 (e.g. FIG. 9) of the locking elements 7 upon the engagement surfaces 11, the control member 5 is able to travel further backwards so that the angle of the control surfaces 9 of the control member 5 with respect to the axis L and correspondingly the angle of the control surfaces 10 of the locking elements 7 can be selected of relatively small dimensions. Thus, the breech block 4 is held in place over a longer period to thereby improve the operational safety with different cartridge charges (soft to magnum) and to enable a greater tolerance for a subsequent securement and interruption of the trigger system.

Photographs taken with a high speed camera have shown that the control member 5 is shifted in this phase nearly all the way backwards towards its end position upon the boundary surface 21, with the breech block 4 continuously opening along the length of the control surface 9.

Figure 3:
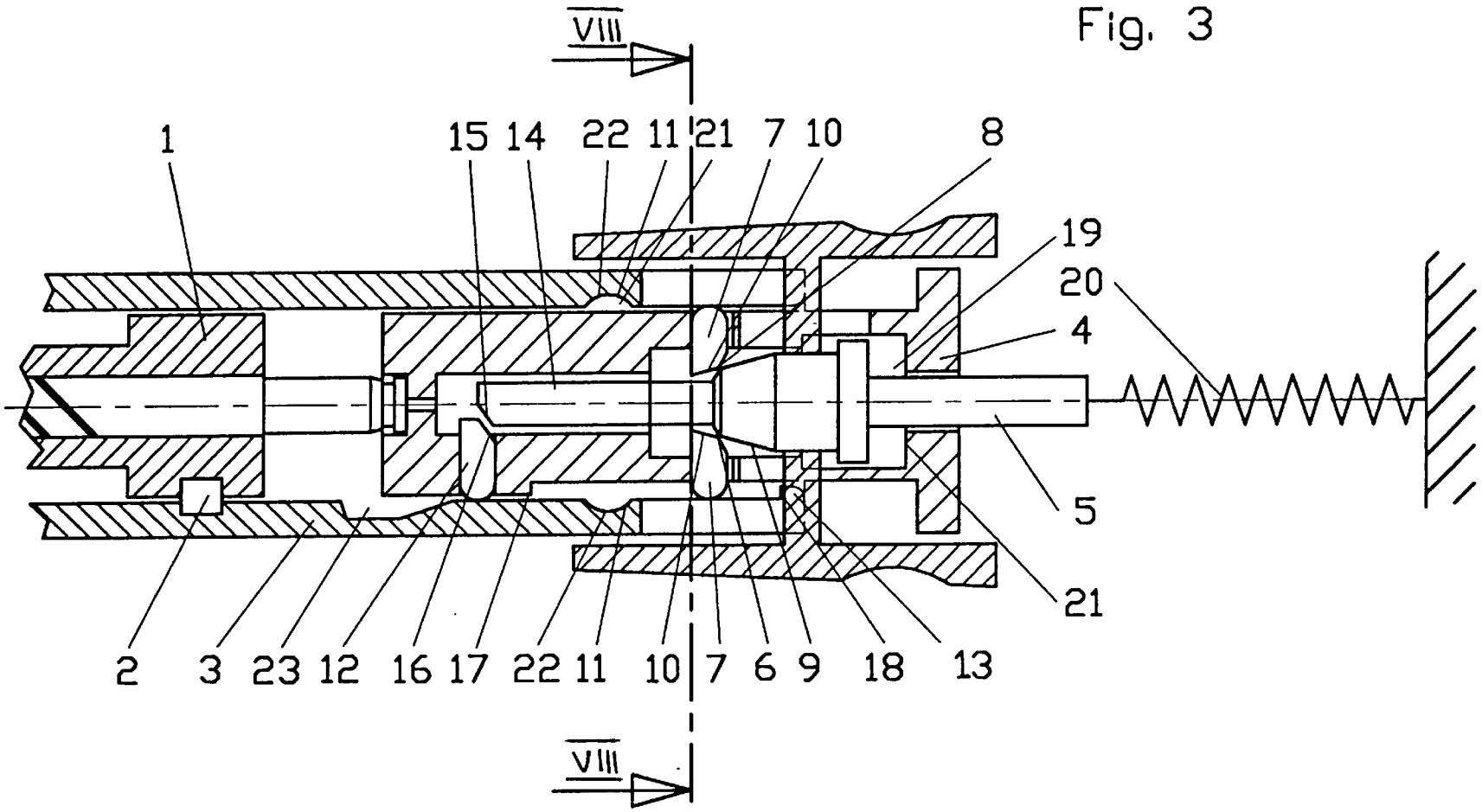
FIG. 3 is a fragmented, schematic longitudinal section of the firearm, illustrating the locking system at the beginning release of the breech block.
Figure 8:
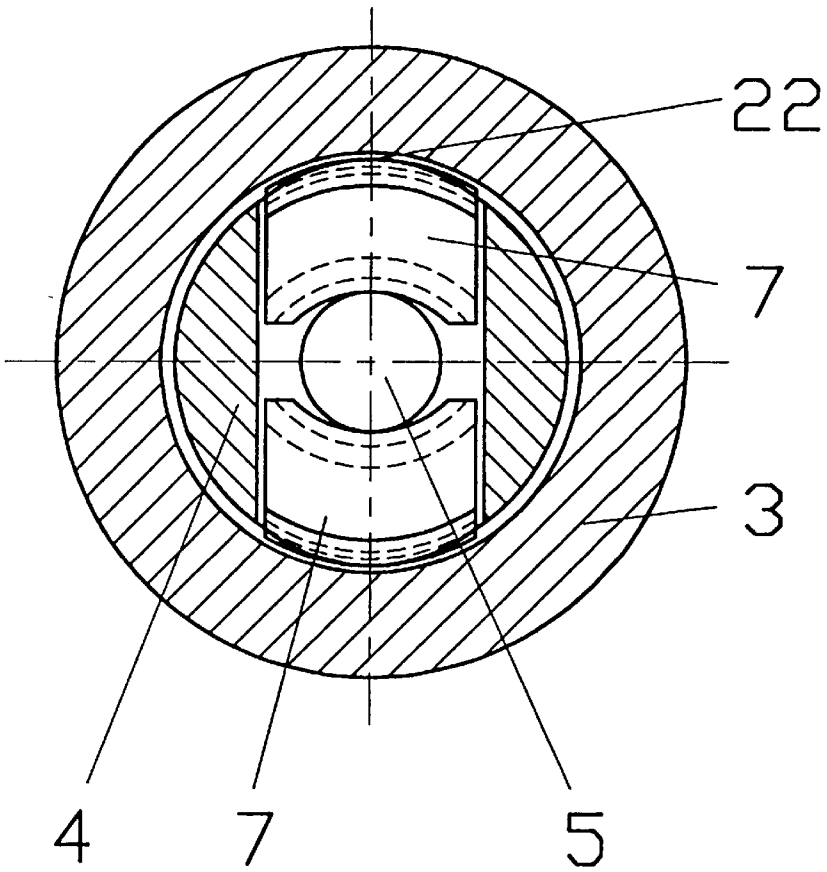
FIG. 8 is a cross sectional view of the firearm taken along the line VIII—VIII in FIG. 3.

As shown in FIG. 3, the locking elements 7 are now freed and are shifted radially inwards by the engagement surfaces 11 in the stock 3 (FIG. 8) so that the breech block 4 is released and is able to shift further backwards. Thus, only after complete disengagement by the still prevailing fume pressure in the cartridge is the breech block 4 further opened in opposition to the force of the closing spring 20. This is the second phase of dividing the recoil energy.

The locking elements 7 are shifted radially inwards and are pressed with their control surfaces 8 upon the control surfaces 6 of the control member 5 against the inside of the stock 3. The angle between the control surface 6 of the control member 5 as well as the respective angle of the control surface 8 of the locking element 7 is as great as possible and suitably lies close to a self-locking action in order to enable a rapid further inward motion of the locking elements 7 and thus to attain a quick removal from the inside of the stock 3 to thereby prevent frictional forces between the locking element 7 and the stock 3.

Figure 9:
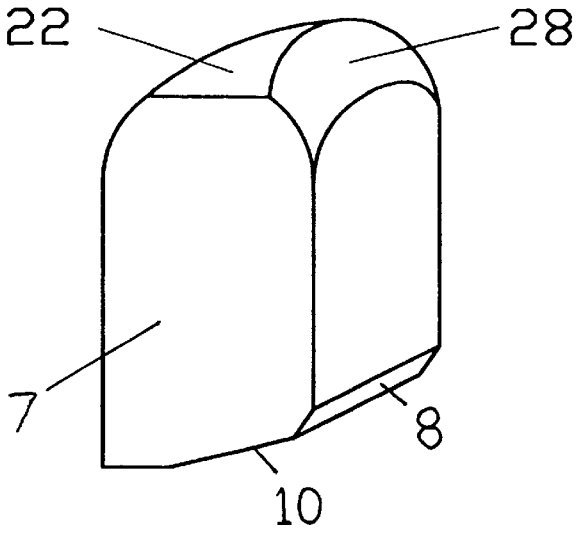
FIG. 9 is an isometric view of a first type of a locking element.
Figure 10:
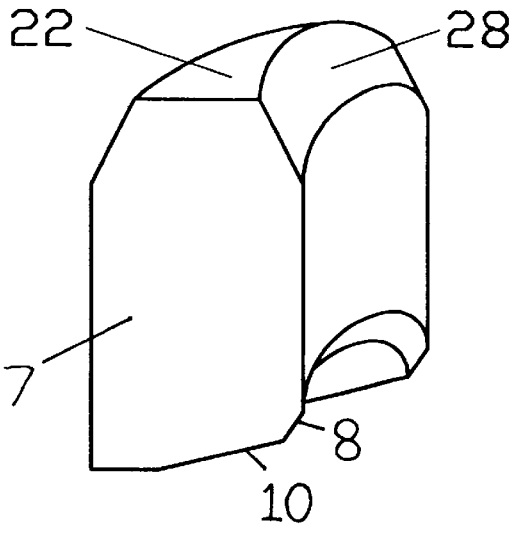
FIG. 10 is an isometric view of a second type of a locking element.
Figure 9A:
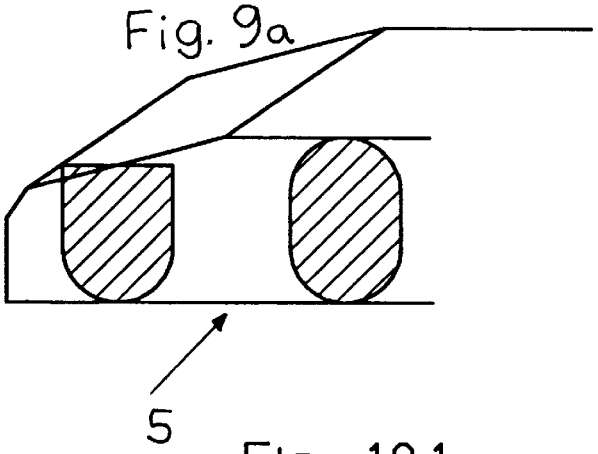
FIG. 9*a* is an isometric illustration of a control member for cooperation with the locking element of FIG. 9.
Figure 10A:
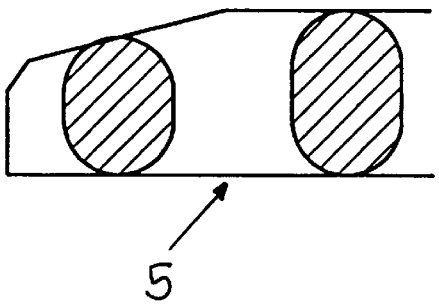
FIG. 10*a* is an isometric illustration of a control member for cooperation with the locking element of FIG. 10.
Figure 10A:
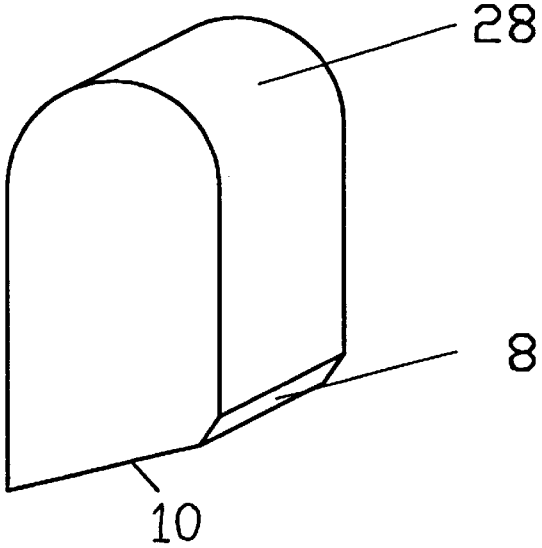

The radial inward motion of the locking elements 7 is further enhanced by forming the locking elements 7 in the area of greatest diameter of their engagement surfaces 22 with a transition (impact area 28) towards the inner diameter of the stock 3 and outer diameter of the breech block 4 in the range of about 20% of the travel of the locking elements 7, as shown in FIGS. 7–10. FIG. 9 shows one type of a locking element 7 for use with a control member 5, as shown in FIG. 9*a* and configured of flat shape, while FIG. 10 shows another type of a locking element 7 for use with a control member 5, as shown in FIG. 10*a* and configured of rounded shape. FIG. 10.1 shows a third type of locking element 7 for cooperation with a prismatic breech.

The support pin 12, which for ease of illustration is shown in a turned position in the drawing plane, is released by the prolongation 14 of the control member 5 and is shifted radially inwards by the ramp 23*a* of the pocket 23 so as to be positioned in front of the control surface 15 of the prolongation 14. The locking system is of such configuration that the support pin 12 cannot enter in the engagement surface 11.

Figure 4:
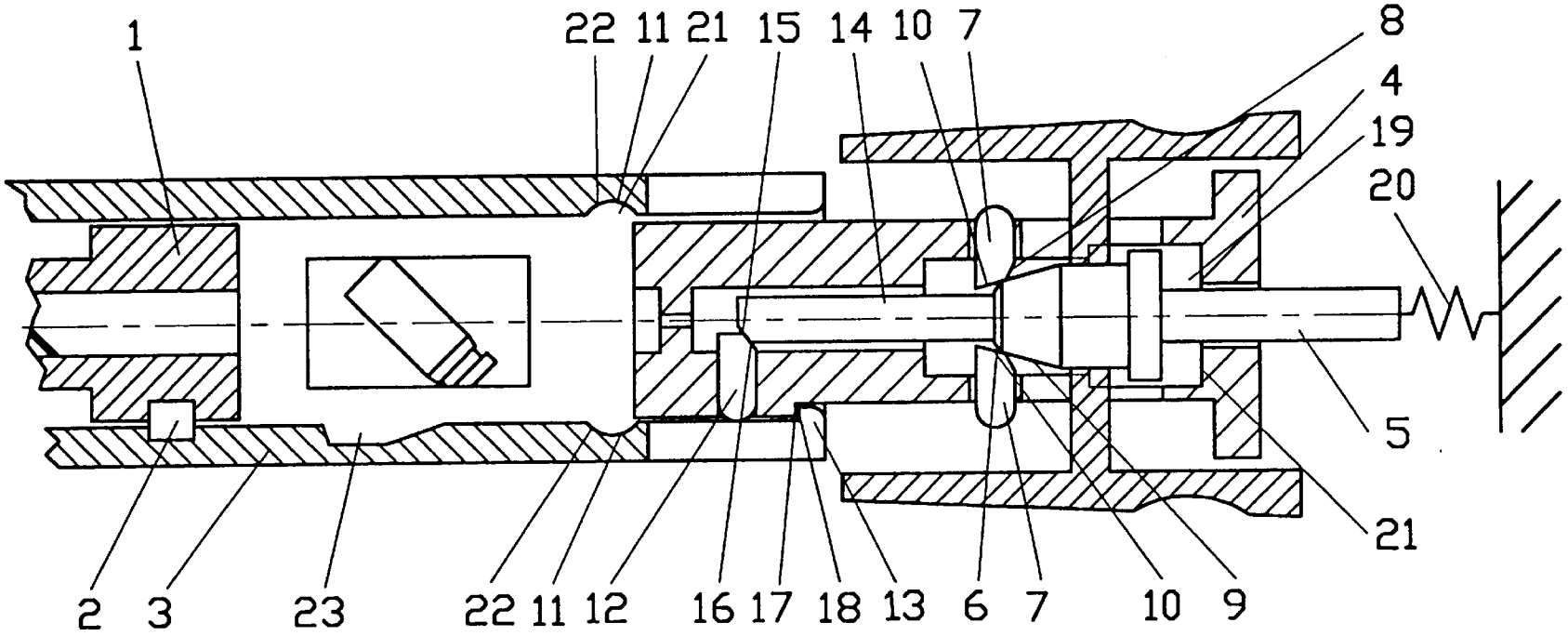
FIG. 4 is a fragmented, schematic longitudinal section of the firearm, illustrating the locking system at fully opened breech block.

As soon as the breech block 4 together with the locking element 7 is withdrawn from the stock 3, as shown in FIG. 4, the spring-loaded control member 5 together with its prolongation 14 is supported by the support pin 12 and thus is able to shift the locking element 7 by means of its control surface 6 only to a limited extent beyond the inner diameter of the stock 3. The shoulder 17 of the breech 4 impacts upon the stop member 13 to transmit a further portion of the recoil energy to the stock 3. This is the third phase of the distribution of the recoil energy. The empty cartridge case is ejected in the meantime.

Figure 5:
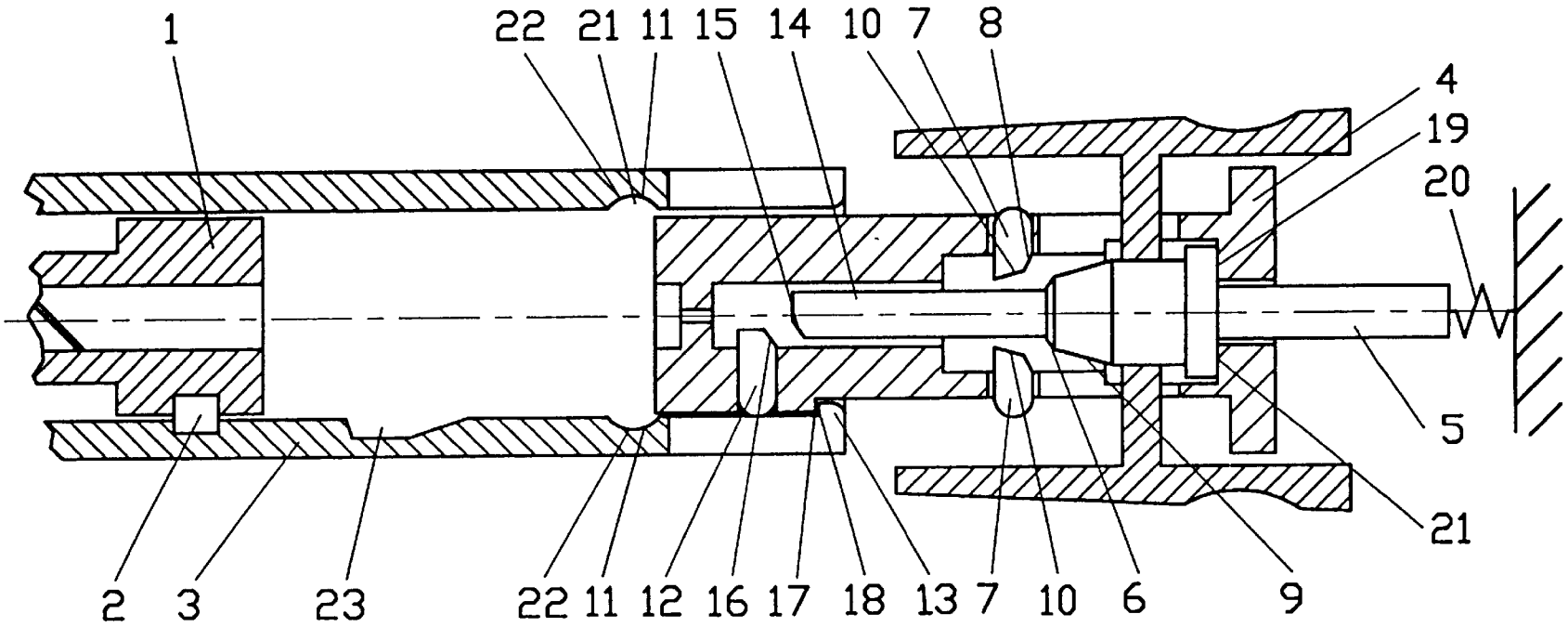
FIG. 5 is a fragmented, schematic longitudinal section of the firearm, illustrating the locking system with its control member occupying its rearmost position.

FIG. 5 shows the fourth phase of distribution of the energy. The control member 5 has impacted the boundary surface 21 of the breech 4 with its stop plate 5*b* to absorb the remainder of the recoil energy. The impact of the breech 4 upon the stop member 13 is significantly minimized by the function of the control member 5 as post impact mass. Moreover, the return of the breech 4 is delayed and allows a longer period for automatic recharging of the next cartridge.

Figure 6:
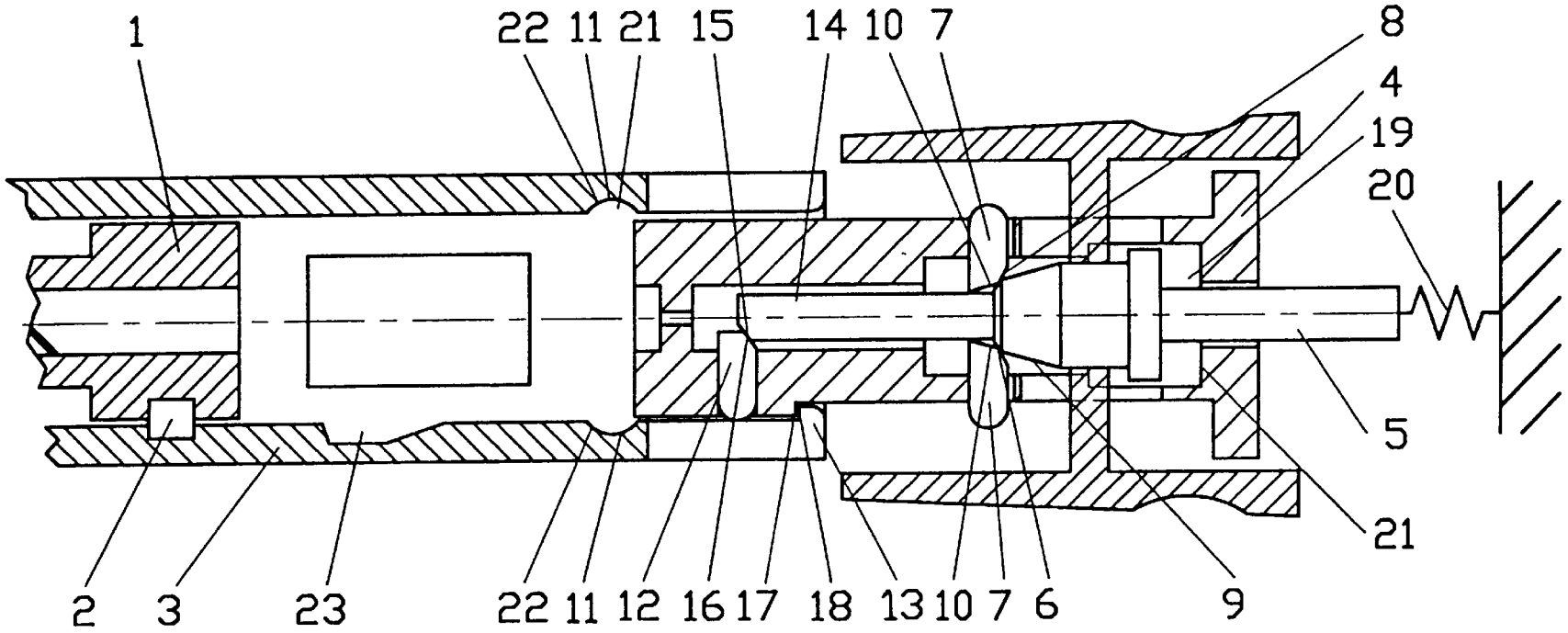
FIG. 6 is a fragmented, schematic longitudinal section of the firearm, illustrating the locking system at commencement of return of the breech block.

The return of the breech block 4, as shown in FIG. 6, is effected by the closing spring 20 which forces the control member 5 with its control surface 15 against the control surface 16 of the support pin 12. During the return movement, the end face of the breech block 4 strips a top cartridge from a magazine and thrusts it into a chamber ready to fire. Finally, the breech 4 occupies the position as shown in FIG. 1.

In the first phase, the locking operation is effected by the control surfaces 8 of the locking elements 7 and the control surface 6 of the control member 5. After a stroke of about 25% of the overall stroke of the locking elements 7, the transfer into total locking is effected. At the same time, the support pin 12 is pressed via the control surfaces 15, 16 into the pocket 23. During locking operation, the control member 5 serves as post impact mass with reverse movement direction with respect to the opening process.

The locking system as shown in FIGS. 1 to 6 results in a short configuration of the firearm by forming the engagement surfaces 11 behind the ejection opening in the stock 3, and a high cartridge power is effected by at least pairwise arrangement of the locking elements 7.

Figure 11:
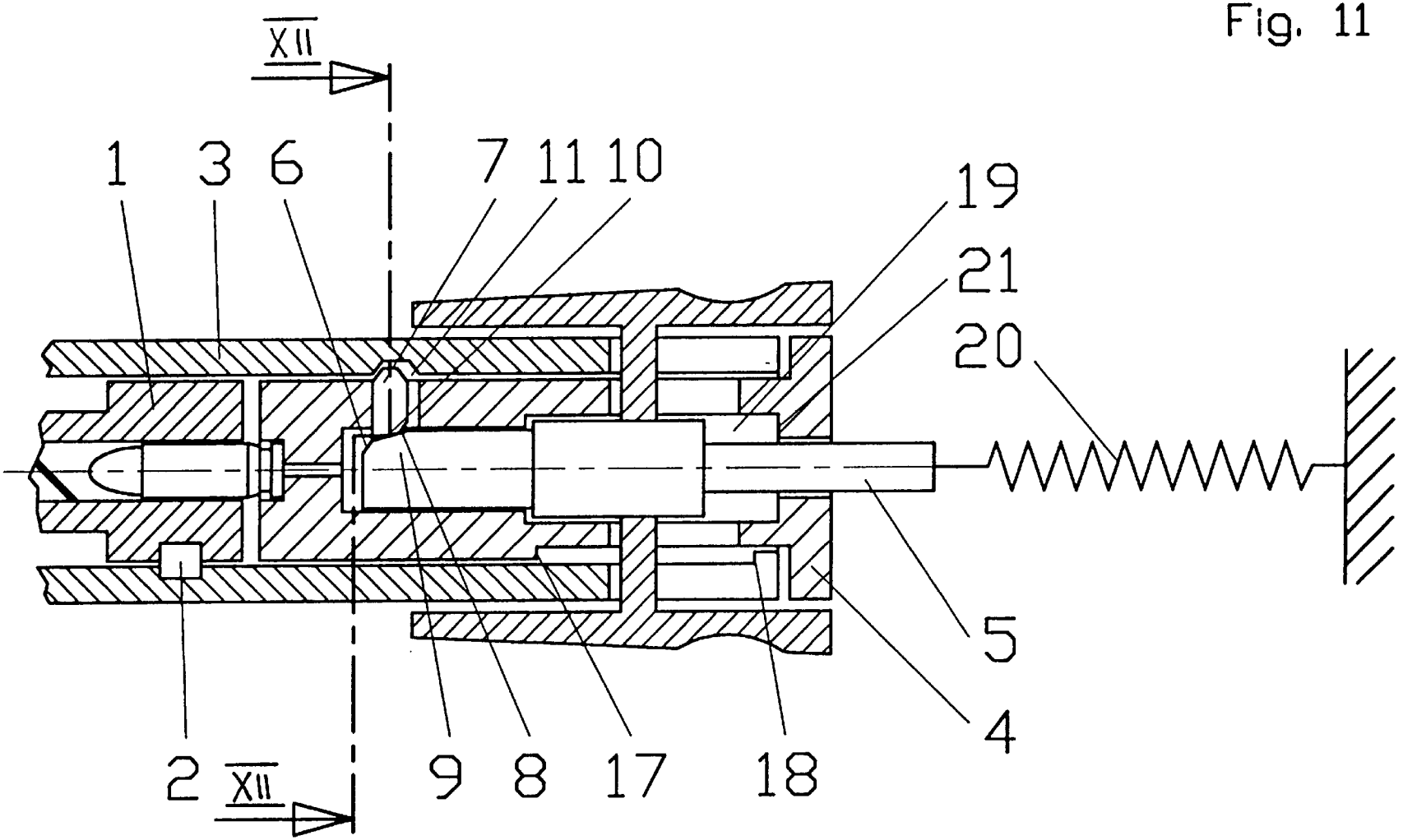
FIG. 11 is a fragmented, schematic longitudinal section of a firearm according to the present invention, illustrating another embodiment of a locking system in locked disposition of the breech block mechanism.
Figure 12:
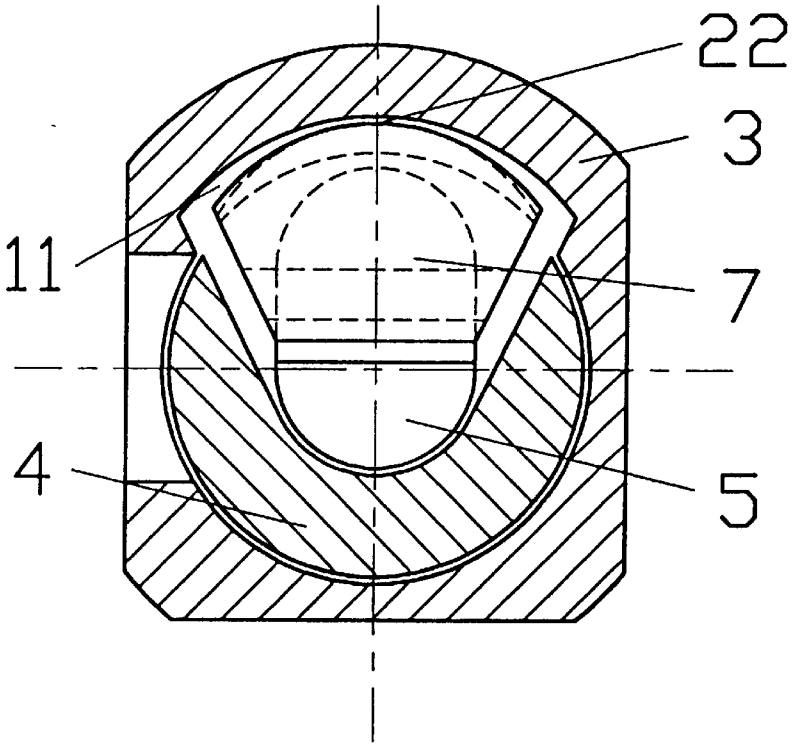
FIG. 12 is a cross sectional view of the firearm taken along the line XII—XII in FIG. 11.

Turning now to FIGS. 11–18, there is shown a second embodiment of a locking system according to the present invention which is applicable up to a cartridge energy of 9 mm Luger caliber. As shown in FIG. 11, which shows the locking system in locked disposition of the breech block 4, only one locking element 7 is provided. In order to create a greatest possible engagement surface 22 of the locking element 7 as well as of the engagement surface 11 in the stock 3 and moreover, to weaken as little as possible the cross section of the breech block 4, the locking element 7 is configured in axial direction of the breech block 4 essentially in form of a sector with clipped tip, as shown in FIG. 12. The engagement surface 22 of the locking element 7 is designed at cylindrical breech block 4 in form of a conical surface and at prismatic breech block 4 in form of a prism surface. A clearance is created between the end 22 of the locking element 7 and the engagement surface 11 in the stock 3, as shown in FIG. 11. Further, the end 22 is so disposed as to be offset relative to the cartridge ejection opening by approximately 90°.

Figure 13:
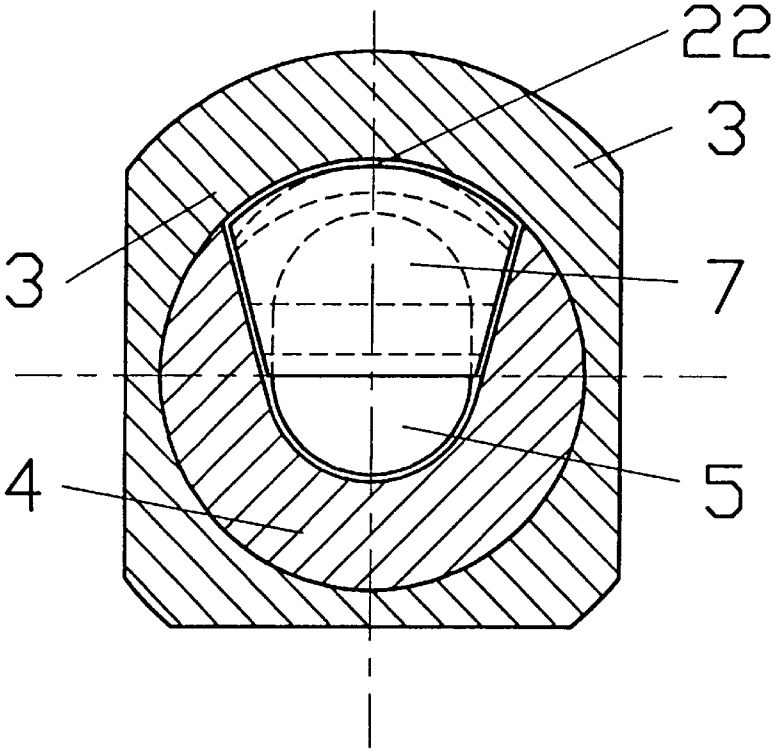
FIG. 13 is a cross sectional view of the firearm taken along the line XIII—XIII in FIG. 15.
Figure 14:
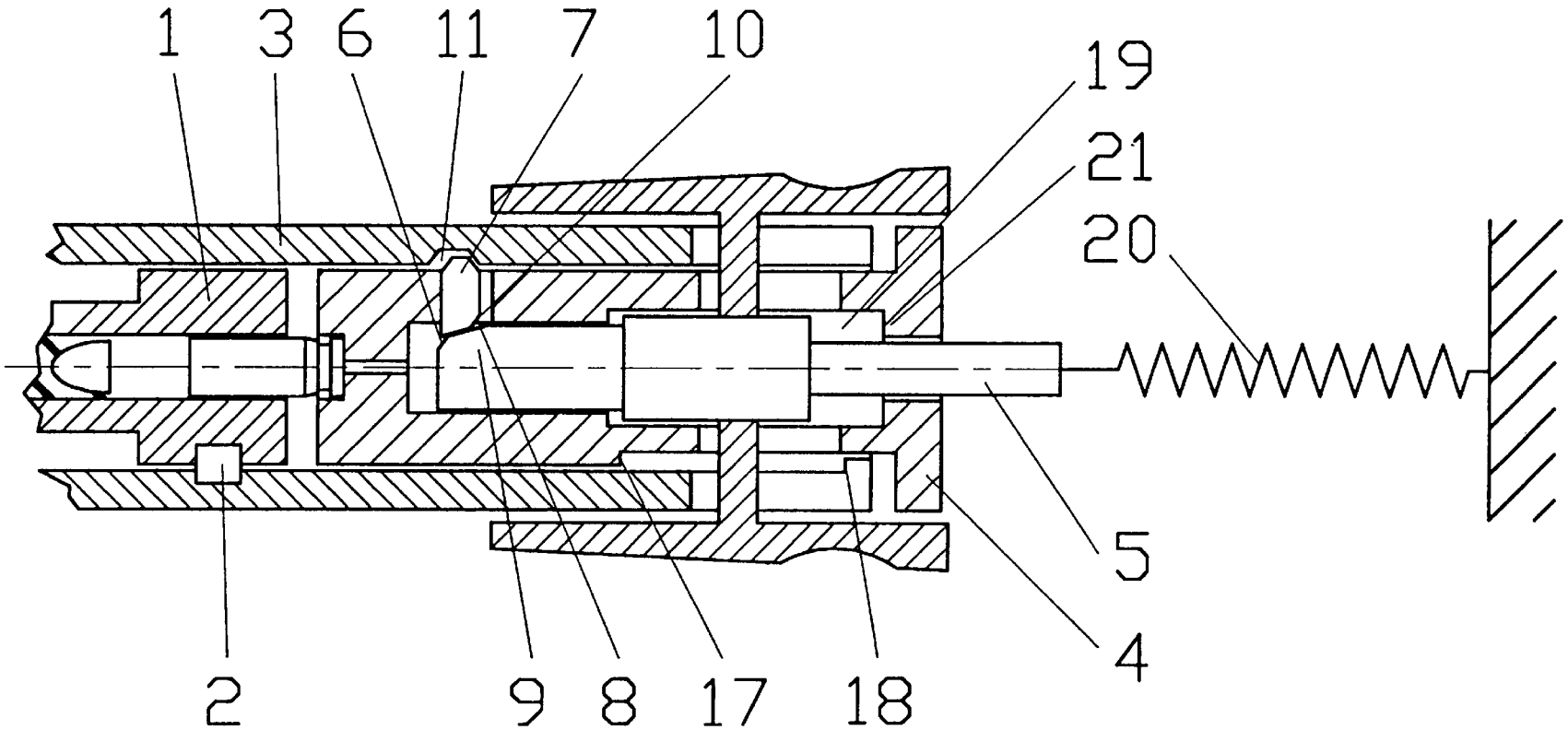
FIG. 14 is a fragmented, schematic longitudinal section of the firearm of FIG. 11, illustrating the locking system at the moment of firing the cartridge.
Figure 15:
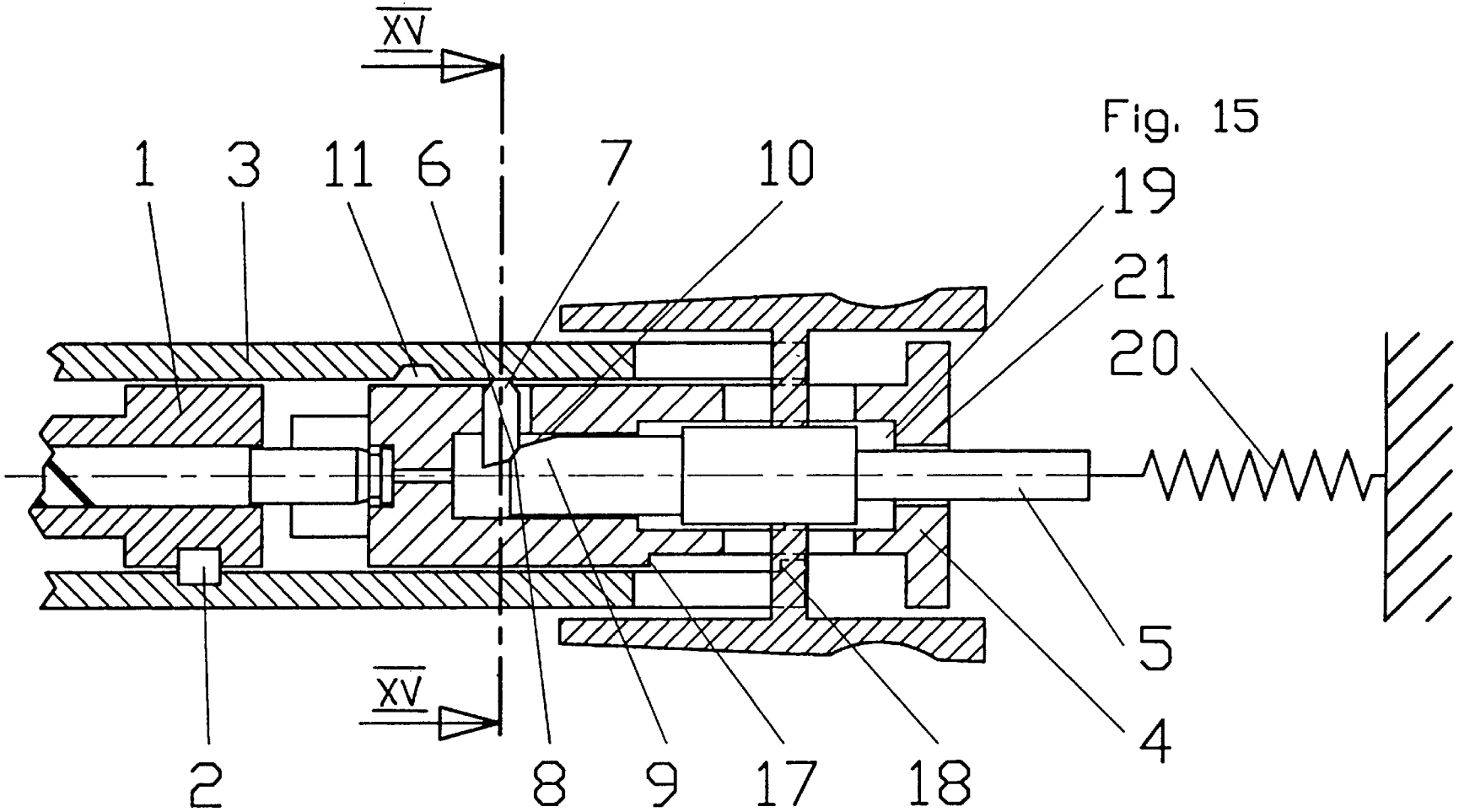
FIG. 15 is a fragmented, schematic longitudinal section of the firearm of FIG. 11, illustrating the locking system at the beginning release of the breech block.
Figure 16:
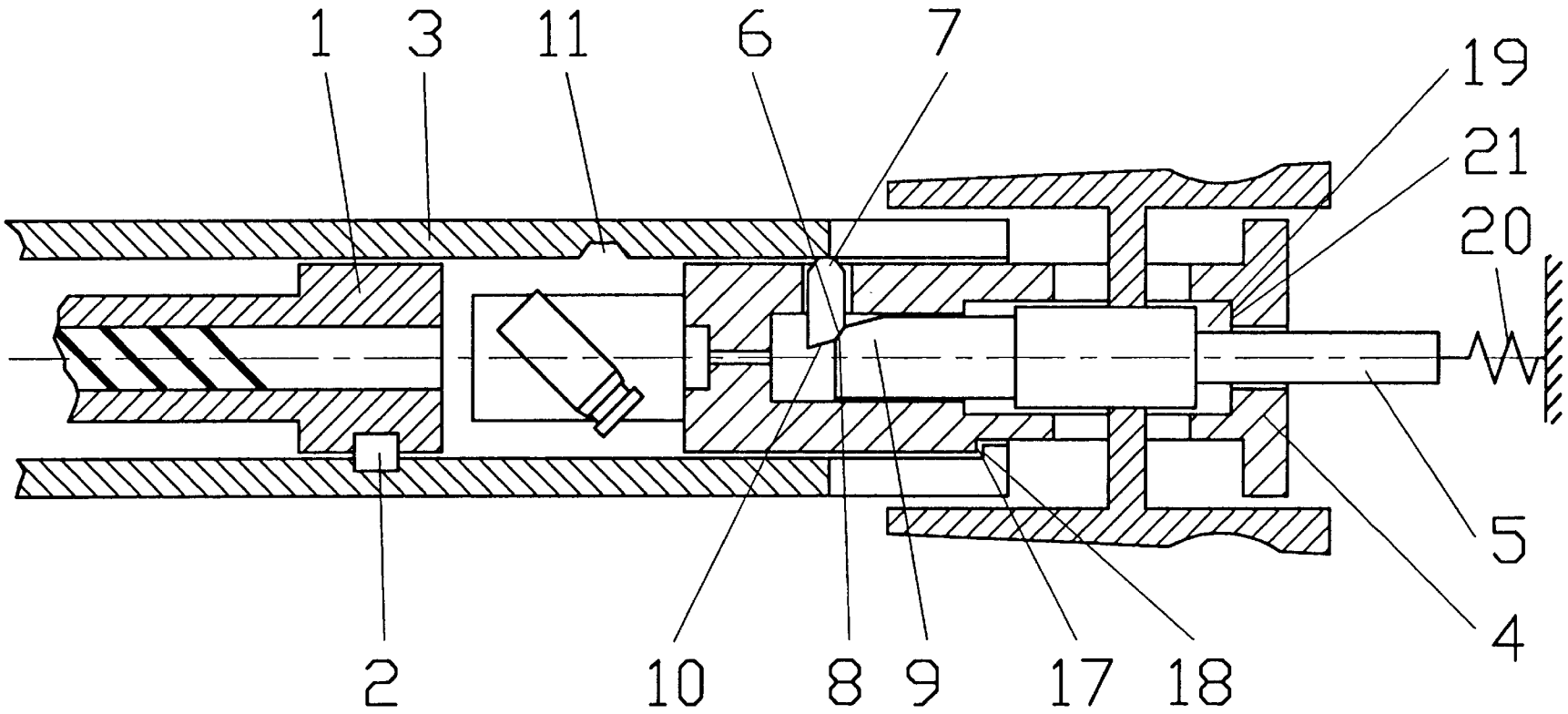
FIG. 16 is a fragmented, schematic longitudinal section of the firearm of FIG. 11, illustrating the locking system at fully opened breech block.
Figure 17:
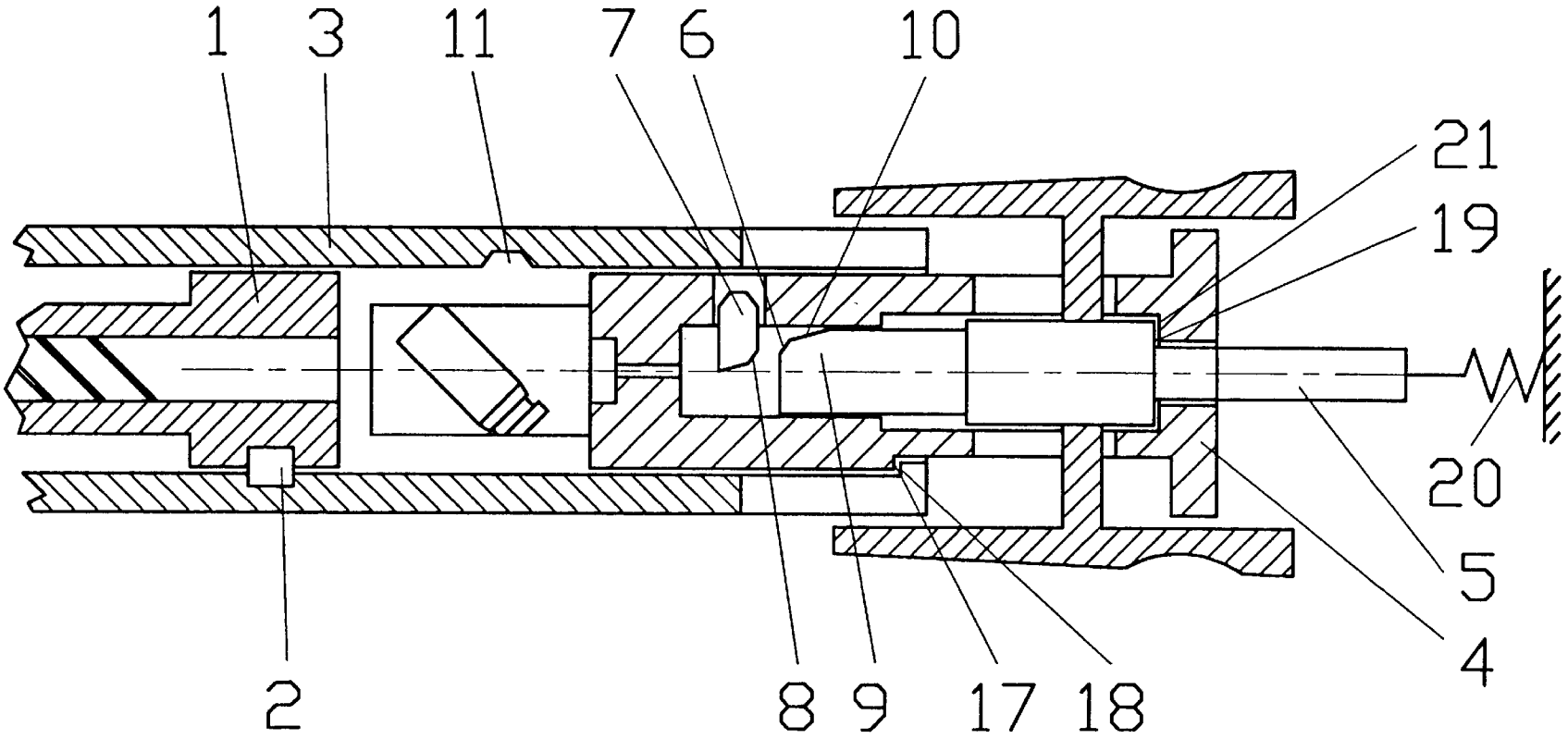
FIG. 17 is a fragmented, schematic longitudinal section of the firearm of FIG. 11, illustrating the locking system with its control member occupying its rearmost position.
Figure 18:
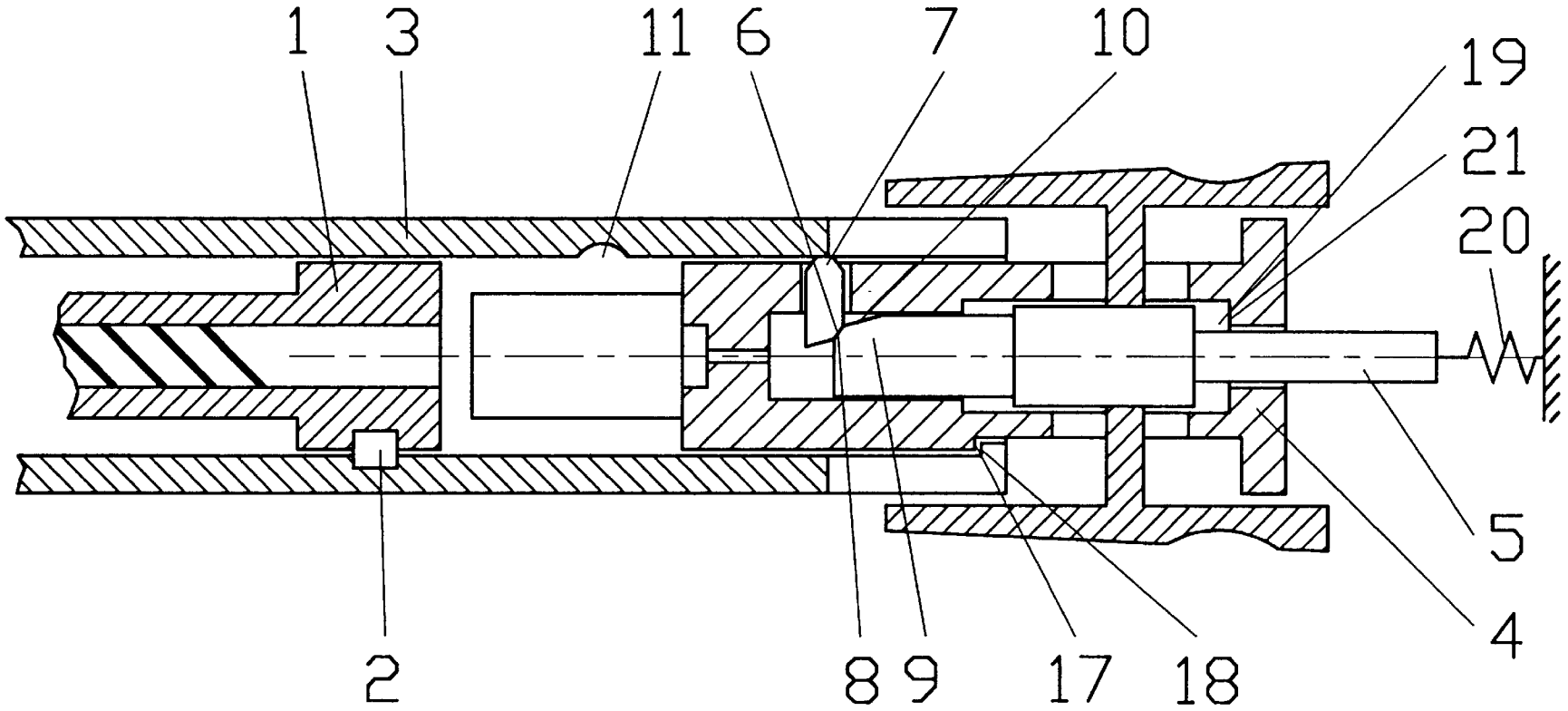
FIG. 18 is a fragmented, schematic longitudinal section of the firearm of FIG. 11, illustrating the locking system at commencement of return of the breech block.

Upon firing of the cartridge and propulsion of the bullet through the barrel 1, the breech block 4 together with the control member 5 receives an impulse. As described in connection with the embodiment of the locking system according to FIGS. 1–6, the breech block 4 and the control member 5 act in the area of the clearance as kick absorber for absorbing a first part of the recoil energy. After complete disengagement of the breech block 4, as shown in FIG. 15, the locking element 7 is completely received within the breech block 4 because the locking element 7 is freed from the control member 5 and radially inwardly shifted by the engagement surface 11, as also shown in FIG. 13. This represents a second phase of absorption of the recoil energy. The breech block 4 together with the control member 5 moves further backwards within the stock 3 until the shoulder 17 impacts upon the stop surface 18 whereby at the same time, the cartridge is ejected. This represents a third phase of distributing the recoil energy. Subsequently, the control member 5 is hurled in opposition to the closing spring 20 through the cavity 19 against the boundary surface 21 so that the fourth phase of the energy absorption is effected, as shown in FIG. 17.

Subsequently, under the action of the closing spring 20, the breech 4 is returned forward whereby the control member 5 engages with its control surface 6 the control surface 8 of the locking element 7 until the locking element 7 is received in the engagement surface 11 to thereby lock the breech block 4 in place with respect to the stock 3.

The locking process is effected in a first phase via the control surface 6 of the control member 5 and the control surface 8 of the locking element 7, and after a stroke of about 25% of the overall stroke in a second phase is effected via the control surface 9 of the control element 5 and the control surface 10 of the locking element 7, with the control member 5 acting as post impact mass in a same manner as during the opening process.

While the invention has been illustrated and described as embodied in a semirigid locking system for a firearm, it is not intended to be limited to the details shown since various modifications and structural changes may be made without departing in any way from the spirit of the present invention.

What is claimed as new and desired to be protected by Letters Patent is set forth in the appended claims:

1. A semi-rigid locking system for a firearm having a barrel, a stock mounted to the barrel and including a locking surface which is stationary in the stock, and a breech block accommodated in the stock and defining an axis, the breech block displaceable between a locking position in which the breech block is locked with respect to the stock and a release position in which the breech block is unlocked with respect to the stock, said breech block having at least one bore, said locking system comprising:

a spring-biased control member supported within the breech block and comprising a plurality of control surfaces which are inclined at different angles with respect to the axis;

a locking element received in the bore of the breech block and movable in a radial direction, said locking element comprising control surfaces which are complementary to the control surfaces of the control member, wherein when the breech block is in the locking position, the locking element is supported by the control member and engages the stationary locking surface, with a clearance provided between the stationary locking surface and the locking element on a side facing away from the barrel, and out of registration with the engagement surface of the stock in the release position of the breech through displacement of the control member in parallel relationship to the breech, said control member exhibiting control surfaces which extend at different angle relative to the axis for cooperation with complementary control surfaces on the locking element: and wherein when the breech block is in the release position, the locking element is released by the control member which moves in the breech block parallel to the barrel axis, and is free to move without engaging the locking surface.

2. The locking system of claim 1 wherein the breech block has the form of a cylinder and wherein the locking element when viewed in axial direction of the breech block, has the shape of a sector of a circle which is clipped at the tip.

3. The locking system of claim 1 wherein the breech block has the form of a cylinder and wherein a radially outer side of the locking element is bounded by a toroidal surface with a first radius, and wherein the locking surface is also bounded by a toroidal surface with a second radius, and wherein the second radius is larger than the first radius by half the clearance.

4. The locking system of claim 1 wherein the breech block has the form of a cylinder and wherein the locking element is bounded on a side which is located radially outwardly and faces away from the barrel, by at least one conical surface.

5. The locking system of claim 1 wherein the breech block has a prismatic shape and wherein the locking element also has a prismatic shape.

6. The locking system of claim 1 wherein the breech block has a prismatic shape and wherein a radially outer side of the locking element is bounded by a cylindrical surface with a first radius, and wherein the locking surface is also bounded by a cylindrical surface with a second radius, and wherein the second radius exceeds the first radius by half the clearance.

* * * * *

UNITED STATES PATENT AND TRADEMARK OFFICE

CERTIFICATE OF CORRECTION

PATENT NO. : 5,900,576

DATED : May 4, 1999

INVENTOR(S) : Franz Gabriel

It is certified that error appears in the above-identified patent and that said Letters Patent is hereby corrected as shown below:

Column 7, line 28, delete ", and out of registration with the engage-";
lines 29 - 33, delete completely;

Column 8, line 1, delete completely;
line 2, delete "locking element".

Signed and Sealed this

Eleventh Day of April, 2000

*Attest:*

*Attesting Officer*

Q. TODD DICKINSON

*Director of Patents and Trademarks*